US009701520B2

(12) United States Patent
Pruskauer

(10) Patent No.: US 9,701,520 B2
(45) Date of Patent: Jul. 11, 2017

(54) HOISTING PLATFORM SYSTEM

(71) Applicant: Mark Alan Pruskauer, Fort Myers, FL (US)

(72) Inventor: Mark Alan Pruskauer, Fort Myers, FL (US)

( * ) Notice: Subject to any disclaimer, the term of this patent is extended or adjusted under 35 U.S.C. 154(b) by 380 days.

(21) Appl. No.: 14/062,282

(22) Filed: Oct. 24, 2013

(65) Prior Publication Data

US 2014/0119866 A1 May 1, 2014

Related U.S. Application Data

(60) Provisional application No. 61/718,505, filed on Oct. 25, 2012.

(51) Int. Cl.

| | |
|---|---|
| ***B66C 23/20*** | (2006.01) |
| ***B66C 23/26*** | (2006.01) |
| ***B66D 1/60*** | (2006.01) |

(52) U.S. Cl.

CPC ..... *B66C 23/205* (2013.01); *B66C 23/26* (2013.01); *B66D 1/605* (2013.01)

(58) Field of Classification Search

CPC ..... B66C 23/205; B66C 23/26; A22B 7/001
USPC ..... 414/592
See application file for complete search history.

(56) References Cited

U.S. PATENT DOCUMENTS 1,562,781 A * 11/1925 Moser ..... B66B 9/187 187/407
2,379,599 A * 7/1945 Smith ..... B66C 23/205 212/175
2,603,362 A 7/1952 Wilson
2,686,600 A * 8/1954 Smith ..... B66C 23/205 212/223
2,830,720 A * 4/1958 Figge ..... B66C 23/205 254/390
2,941,634 A * 6/1960 Hanks, Sr. ..... B66C 23/205 254/390
2,984,444 A * 5/1961 Lewis ..... B66C 23/205 248/163.2
3,953,980 A 5/1976 Bennett
3,978,989 A * 9/1976 Avila, Jr. ..... B66C 23/22 212/176

(Continued)

FOREIGN PATENT DOCUMENTS

CN 200958016 Y 10/2007
EP 1180489 A1 2/2002

(Continued)

*Primary Examiner* — Kaitlin Joerger

(74) *Attorney, Agent, or Firm* — Jason P. Webb; Pearson & Butler

(57) ABSTRACT

A hoisting platform system configured to permit transport of loads to and between floors of a building. The system includes a roof lift having a pair of beams resting on a roof and jutting out therefrom. The roof lift includes a winch coupled to and positioned over the beams. The roof lift includes a mounting structure extending upwardly from the beams with a plurality of cables coupled to and extending from a top region of the mounting structure downwardly at an angle. The cables are fixedly coupled to the roof. The hoisting platform system includes a floor deck disposed below the roof lift. The floor deck is coupled to a floor of the building and extending outwardly therefrom.

20 Claims, 7 Drawing Sheets

(56) References Cited

U.S. PATENT DOCUMENTS 4,004,778 A * 1/1977 Steinhagen ..... B66C 23/205 182/142
4,441,849 A * 4/1984 Dizmang ..... B66C 23/205 254/325
4,496,277 A * 1/1985 Jungman ..... B66C 23/20 212/179
4,535,498 A 8/1985 Webster
4,621,741 A * 11/1986 Boon ..... B66C 23/205 212/175
4,883,184 A 11/1989 Albus
4,962,828 A * 10/1990 Duncan ..... E04G 21/3261 182/138
5,101,935 A * 4/1992 LaBianca ..... A62B 1/06 182/142
5,341,898 A 8/1994 Baziuk
5,622,237 A * 4/1997 Moldow ..... A62B 1/06 182/37
5,934,437 A * 8/1999 Anson ..... B66C 23/202 193/15
6,539,676 B2 * 4/2003 Price ..... E04G 3/34 182/145
6,575,685 B2 * 6/2003 Baxter, Sr. ..... B66C 23/201 187/900
7,070,020 B2 * 7/2006 Preston ..... E04G 3/28 182/82
8,167,153 B1 * 5/2012 Wattel ..... B66C 23/166 182/45
8,544,823 B2 * 10/2013 Imberi ..... B66D 1/36 254/338
9,255,416 B1 * 2/2016 Snell ..... E04G 21/16
2004/0175259 A1 * 9/2004 Singh ..... B66C 23/20 414/680
2005/0236352 A1 * 10/2005 Tien ..... B66C 23/205 212/179
2007/0059142 A1 * 3/2007 Dambroseo ..... B66C 23/205 414/561
2011/0147329 A1 6/2011 Evans et al.
2015/0110581 A1 * 4/2015 Wang ..... B66C 23/205 414/11
2016/0258172 A1 * 9/2016 Snell ..... B66C 23/201

FOREIGN PATENT DOCUMENTS

FR 2672920 A1 8/1992
JP 2002-326783 A1 12/2002
KR 20-0207412 Y1 1/2001

* cited by examiner

HOISTING PLATFORM SYSTEM

CROSS-REFERENCE TO RELATED APPLICATIONS

This invention claims priority, under 35 U.S.C. §120, to the U.S. Provisional Patent Application No. 61/718,505 to Mark Alan Pruskauer filed on Oct. 25, 2012, which is incorporated by reference herein.

BACKGROUND OF THE INVENTION

Field of the Invention

The present invention relates to hoists, specifically a hoisting platform system configured to hoist objects along a side of a building.

Description of the Related Art

An aerial work platform (AWP), also known as an aerial device, elevating work platform (EWP), or mobile elevating work platform (MEWP) is a mechanical device used to provide temporary access for people or equipment to inaccessible areas, usually at height. There are distinct types of mechanized access platforms and the individual types may also be known as a "cherry picker" or a "scissor lift".

They are generally used for temporary, flexible access purposes such as maintenance and construction work or by firefighters for emergency access, which distinguishes them from permanent access equipment such as elevators. Regardless of the task they are used for, aerial work platforms may provide additional features beyond transport and access, including being equipped with electrical outlets or compressed air connectors for power tools. They may also be equipped with specialist equipment, such as carrying frames for window glass.

Some improvements have been made in the field. Examples of references related to the present invention are described below in their own words, and the supporting teachings of each reference are incorporated by reference herein:

U.S. Pat. No. 8,167,153, issued to Wattel, discloses a support system for use on mast climbing scaffolding systems comprising a plate system with integral fastening components that attach along outer edges of a horizontal surface of the scaffolding assembly is herein disclosed. The system is utilized to mount a hoisting device to lift building tools, supplies and materials. The system may be folded thereinto a compact configuration for transport between job sites.

U.S. Pat. No. 6,575,685, issued to Baxter, Sr., discloses a hoisting platform system which is usable in the construction of high rise buildings Included in the system are two I-beams which are mounted on a higher floor of the building under construction which has been finished already. The two I-beams are mounted in a cantilevered fashion with one section jutting forward from the higher floor and another section being attached to the higher floor by several post jacks on top of the I-beams and against the ceiling of the next higher floor. On the forward section there is mounted a pair of A-frames having a cross beam mounted at their tops which in turn has a winch mounted thereon. A movable transfer deck is located between the I's of the two I-beams and can be moved to a position interior of the building once a load is placed thereon. The winch can also be located on the higher floor and idler sheaves can be used on top of the cross beam. The winch is a hydraulic winch which is powered by a hydraulic pump which in turn is powered by an internal combustion engine. There a variations of the A-frames, because a pair of single support struts can be used, which are articulated relative to the two I-beams.

U.S. Pat. No. 6,539,676, issued to Price, discloses portable roof anchor having a slidably adjustable beam member is supported at a pivot location near a line support end and at an opposed end by a rotatably attached self-leveling counterweights. A line wrapped onto the beam member may be used as a handle for carrying the beam member to a roof top, then used to support a person or equipment over a side of the building. The counterweights have a relatively small top cross-section and a relatively large bottom cross-section so that, for any given amount of weight, a relatively large bottom surface area and a relatively tall height from the rooftop will be provided. A handle is provided near a line-deployed center-of-gravity so that the roof anchor assembly may be easily maneuvered, while the line remains over the side of the building, with one hand on the handle and a second hand cradled underneath the beam member. An L-handle bolt/nut combination may be used to rotatably attach the counterweights to the beam member, and also to configure the unattached counterweights into an easily carried, balanced assembly. A parapet mounted portable roof anchor includes a step member and a hand hold to facilitate a person's movement off of and back onto the roof.

U.S. Pat. No. 5,934,437, issued to Anson et al., discloses support generally comprising a mast component, a boom component extending forwardly from the mast component, and a stabilizing component for maintaining the support in a working disposition. The support may be used in conjunction with a lifting pole for forming a hoist system. The support and hoist system may be used to support or raise and lower an object such as a chute for debris.

U.S. Pat. No. 5,341,898, issued to Baziuk, discloses boom assembly for mounting on the roof of the building provides a pulley which receives a cable for depending over a front edge of the building to allow lifting or lowering of materials attached to the cable. The boom assembly can be folded to a relatively small packaged arrangement for ready transportation. The boom assembly can be adjusted to accommodate different orientations of support surface for example inclined or angled roof structures. The boom arrangement includes a vertical post, a counterbalance pole extending rearwardly from the base of the post and a pair of arms extending at right angles to the counterbalance pole. A brace is connected between the top of the post and the counterbalance pole with the base extending outwardly and carrying the pulley at the outer end. A cable arrangement extends between the pulley and a rear end of the counterbalance pole. The angle of the post relative to the counterbalance pole can be adjusted in two directions and also the arms can be raised and lowered as required The inventions heretofore known suffer from a number of disadvantages, including but not limited to being limited in placement (especially on roofs), requiring modification of the floor/roof where it is installed, being expensive, not accelerating construction speed, reducing or failing to improve construction efficiency, being dangerous, not improving revenue/profits of construction companies, not making it easier to meet project deadlines, impacting the structure, requiring substantial rework of the structure to which it is applied when removed therefrom, not permitting use of additional types of equipment during construction that otherwise could not be used, and/or not reducing the need for use of large/expensive cranes and the like and similar disadvantages that would occur to one of ordinary skill in the art upon review of this application.

What is needed is a platform hoisting system that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available platform hosting systems. Accordingly, the present invention has been developed to provide a platform hoisting system for transportation between floors of a building.

According to one embodiment of the invention, there is a hoisting platform system configured to permit transport of loads to and between floors of a building. The system may include a roof lift that may be coupled to a roof of a building. The roof lift may include a pair of beams that may be resting on the roof and may be jutting out from a side of the roof. The roof lift may include a winch that may be coupled to and positioned over the beams. The winch may be a powered winch that may be disposed on a platform that may be extending upwardly from jutting ends of the beams. The platform may be resting on a pair of a-frame struts, each a-frame strut may be coupled to a respective beam.

The roof lift may include a mounting structure that may be extending upwardly from the beams with a plurality of cables that may be coupled to and may be extending from a top region of the mounting structure downwardly at an angle. The mounting structure may include a pole that may be extending upwardly from each of the beams and a cross-beam that may be fixedly coupling each of the poles at a top region thereof. The mounting structure may include a pair of rigid a-frame struts that may be extending upwardly from the beams. The mounting structure may include a cross-beam that may be fixedly coupling struts that may be extending upwardly from each of the beams.

The plurality of cables may be fixedly coupled to the roof. The plurality of cables may include tension adjustment devices. The plurality of cables may include a pair of rear-anchored cables that may be positioned opposite jutting ends of the beams. The plurality of cables may include a pair of side-anchored cables that may be positioned at a radial angle that may be substantially orthogonal to the primary axis of the beams. The beams may be I-beams.

The hoisting platform system may include a floor deck that may be disposed below the roof lift. The floor deck may be coupled to a floor of the building and may be extending outwardly therefrom. The roof lift may include a retractable deck. The floor deck may include a retractable deck. The hoisting platform system may include a plurality of floor decks that may be coupled to different floors of the building and each may be disposed in an array below the roof lift.

According to one embodiment of the invention, there is a roof lift configured to be coupled to a roof of a building. The roof lift may include a pair of beams that may be resting on the roof and may be jutting out from a side of the roof. The roof lift may include a winch that may be coupled to and positioned over the beams. The winch may be a powered winch that may be disposed on a platform that may be extending upwardly from jutting ends of the beams. The platform may be resting on a pair of a-frame struts, each a-frame strut may be coupled to a respective beam.

The roof lift may include a mounting structure that may be extending upwardly from the beams with a plurality of cables that may be coupled to and extending from a top region of the mounting structure. The mounting structure may include a cross-beam that may be fixedly coupling struts that may be extending upwardly from each of the beams. The struts may be extending upwardly from each of the beams form a-frames. The beams may be I-beams. The plurality of cables may include tension adjustment devices. The roof lift may include a retractable deck. The roof lift may include a plurality of anchors that may be coupled to ends of the cables.

According to one embodiment of the invention, there is a hoisting platform system configured to permit transport of loads to and between floors of a building. The system may include a roof lift configured to couple to a roof of a building. The roof lift may include a pair of beams that may be resting on the roof and may be jutting out from a side of the roof. The roof lift may include a powered winch that may be coupled to and positioned over jutting portions of the beams. The roof lit may include a set of rigid struts that may be extending upwardly from the beams and may be coupled to each other at a top region of the struts by a cross-beam. The roof lift may include a plurality of tension-adjustable cables that may be coupled to and extending from a top region of the struts. The roof lift may include a plurality of anchors that may be coupled to distal ends of the cables and configured to anchor the cables to a top surface of a roof. The roof lift may include a retractable deck that may be disposed between the jutting portions of the beams. The hoisting platform system may include a plurality of floor decks with retractable decks configured to be disposed below the roof lift in an array, configured to be coupled to various floors of a building and to extend outwardly therefrom.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
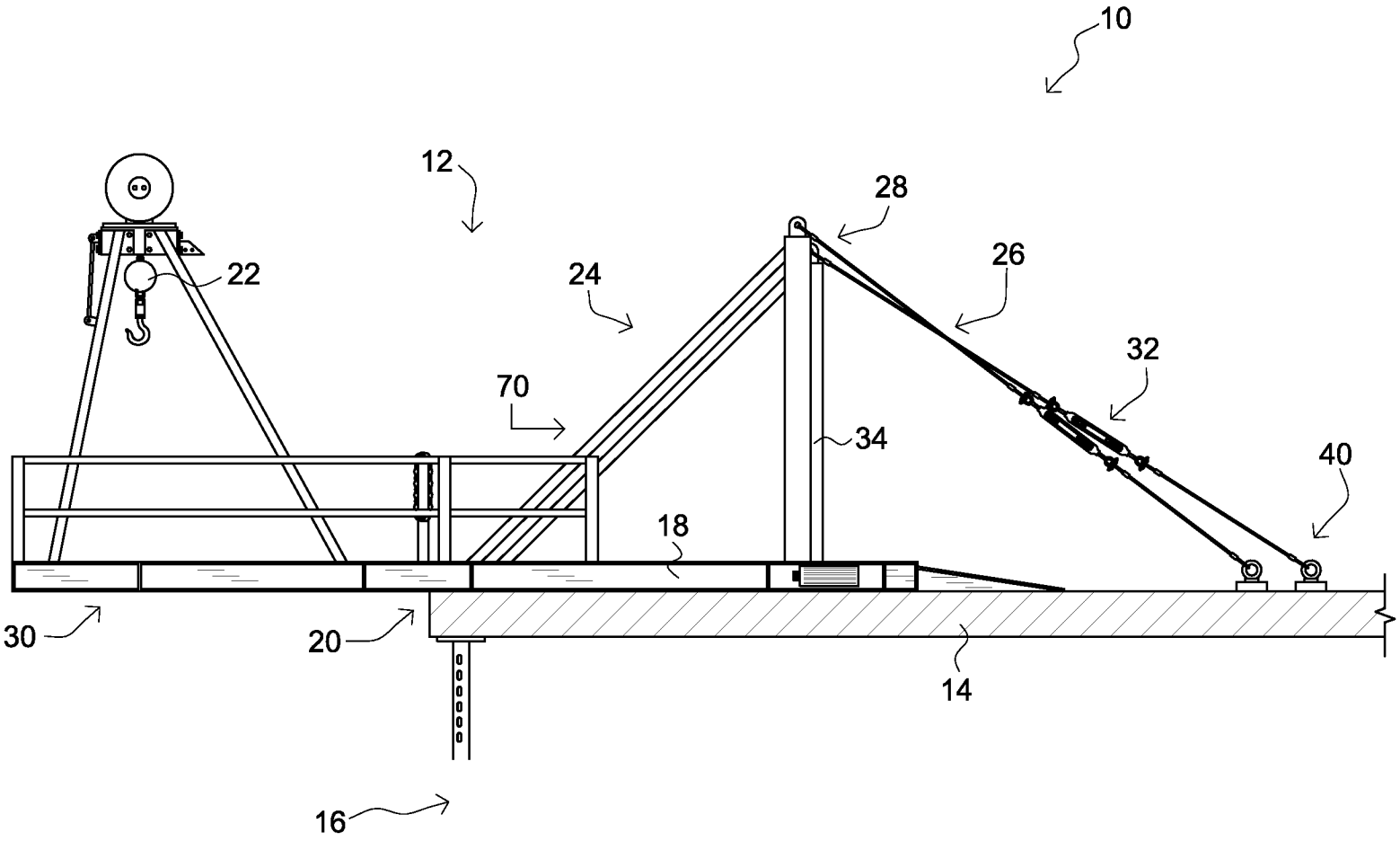
FIG. 1 is a side elevational view of a roof lift of a hoisting platform system, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of " and "consisting essentially of."

FIG. 1 is a side elevational view of a roof lift of a hoisting platform system, according to one embodiment of the invention. There is shown a roof lift 12 having a winch 22, a floor deck 30 and coupling structures configured to couple the roof lift 12 to a top surface of a roof 14. Accordingly, the roof lift 12 is able to couple to a roof 14 of a structure 16, thereby permitting access to every level of the structure 16 including the rooftop. The roof lift 12 is able to couple strongly to the rooftop at a low cost and with strength sufficient to allow the winch to transport large loads to the various floors of the structure 16.

The hoisting platform system 10 is configured to be anchored to a floor-surface (floor) of a building or structure, including but not limited to a top surface or roof 14 of a structure 16, especially of a building under construction or repair. Advantageously, the roof lift 12 is able to couple to a structure without wedging itself between adjacent surfaces and therefore does not require a second surface against which to brace itself. The illustrated hosting platform system 10 is coupled to a roof 14 of a building 16 or structure. The hoisting platform system 10 may be configured to be coupled to other structures, such as but not limited to a surface of a bridge extending off a side thereof. The hoisting platform system 10 is configured to be attached to a structure 16 able to support the hoisting platform system 10, typically a high-rise building 16.

The illustrated hoisting platform system 10 includes a mounting structure 24 configured to be anchored to a roof top of a building 16. The illustrated mounting structure 24 is coupled to a pair of I-beams 18 that jut out beyond the surface of the roof 14. The I-beams 18 further support a winch 22 configured to lift objects from an area below the roof lift 12. The roof lift 12 is disposed jutting over a side 20 of a building 16, wherein the floor deck 30 is configured to lift objects along the side 20 of the building 16 to various levels and floors of the building 16.

The illustrated mounting structure 24 is configured to support the roof lift 12 during operational use. The illustrated mounting structure 24 includes a pair of upright poles 34 configured to apply downward pressure to the I-beams 18 during operational use, thereby securing the I-beams 18 to the surface 14 of the building 16 and providing a counter force to force applied to the winch 22 by lifted objects. The mounting structure 24 includes a plurality cables 26 configured to securely anchor the mounting structure 24 to a surface, generally a rooftop 14 of a building 16. The plurality of cables 26 are configured to couple the pair of upright poles 34 about a top end 28 thereof. The plurality of cables 26 anchor to a rooftop 14 of a structure 16. The illustrated cables 26 anchor by being coupled to eye-bolt anchors that are fixedly coupled to the surface 14. The illustrated cables 26 include tension adjustment devices 32 (the illustrated devices are turnbuckles) that allow for adjusting tension of the cables 26 after the anchors are in place. Accordingly, the tension may be increased and/or decreased as appropriate for proper anchoring, which may vary between uses based on expected winch loads.

The illustrated plurality of cables 26 extends from top ends 28 of the pair of upright poles 34 rearwardly to anchor a distance away from the rest of the roof lift 12. The illustrated upright poles 34 include counterbalancing braces 70 extending forward from the upright poles 34 (though such braces could extend rearwardly as well or alternatively). The plurality of cables 26 includes a plurality of anchors 40 configured to securely couple the cables 26 to a rooftop structure 14 of a building 16. In various non-limiting examples, the plurality of cables extend towards a front, a back, and or side (or combinations thereof) of an upright pole.

In one non-limiting embodiment, there is a hoisting platform system 10 which is usable in the construction of high rise buildings. Included in the system 10 are two I-beams 18 (or other, similar, support structures, base(s) or platform(s)) which are mounted on a higher floor of the building under construction which has been finished already. The two I-beams 18 are mounted in a cantilevered fashion with one section jutting forward from the higher floor and another section being attached to the higher floor by one or more structures described herein. On the forward section there is mounted a pair of A-frames having a cross beam mounted at their tops which in turn has a winch mounted thereon. A movable transfer deck 30 is located between the I's of the two I-beams and can be moved to a position interior of the building once a load is placed thereon. The winch 22 can also be located on the higher floor and idler sheaves can be used on top of the cross beam. The winch 22 may be a hydraulic winch which is powered by a hydraulic pump which in turn may be powered by an internal combustion engine. There a variations of the A-frames, because a pair of single support struts can be used, which may be articulated relative to the two I-beams.

In still another embodiment, there is a hoisting platform system 10 adapted to pick up a load on the ground and to deliver the load to a higher floor of a building under construction. Such a system may include two stationary I-beams 18 installed on said higher floor, said I-beams jutting forward from an edge of said higher floor in a cantilever fashion and having forward sections and rear sections, said rear sections of said I-beams 18 are attached to said higher floor. There is a mount 24 for a winch 22 above said I-beams 18 and above said forward sections and attached thereto. There is a power supply to the winch 22 from a location remote from the winch. There is a transfer deck 30 movably mounted between the jutting I-beams 18 from the forward section to a rear position which may generally be interior of the building 16. The hoisting platform 10 may be coupled to a floor or roof of a building using one or more of the structures described herein.

In still yet another embodiment, there is a structure 24 that attaches in a cantilever manner onto floors or roof 14 of a building 16. Such may also cantilever off a basement, bridge, and etc. There may be two poles applying downward pressure on the structure by attaching connections to roof/surface/ground/etc. There may be two strut support poles that attach to the hoist by a pair of horizontal struts. There may be a generally horizontal support pole between the two upright poles and such may be attached along a top region of one or more of the support poles. There are support devices (wires, cables, chains, struts, etc.) that extend at an angle of declination from top regions of the support poles and that splay at varying radial angles (when viewed from the top) that attach the tops of the upright poles to a surface (roof, floor, etc).

In still yet a further embodiment, there is a pair (or more) of upright poles 34 coupled to a pair of hoist support struts 18 that are connected to a hoist. The upright poles 34 are coupled together by a support structure 24 therebetween that stabilizes the pole tops in the direction of each of the other poles. There are also support structures that couple the tops of the poles to fixed positions at each of the other cardinal (or other) directions for each pole. These support structures may be cables that extend out in each cardinal direction from the pole tops and may be secured to a surface on which the hoist support struts are coupled, the hoist support struts themselves, and or the poles. The support structures can include tension adjustment devices to adjust the effective length and/or support provided by each structure, such may include one or more turnbuckles, cinches, knots systems, ratcheting systems, and the like and combinations thereof.

Advantageously, a system of floor decks and roof lift(s) may be utilized instead of or in cooperation with a crane to increase the speed and efficiency of construction. In particular, a hoisting platform system 10 is much less expensive than a crane, faster to setup and less expensive to operate. This increases speed of construction and decreases costs. Hoisting platform systems that are not able to lift materials to the roof may still require assistance from a crane and/or other roof access structures/devices and thus may fail to realize the full potential of speed and savings that may be achieved with a hoist platform system.

Figure 2:
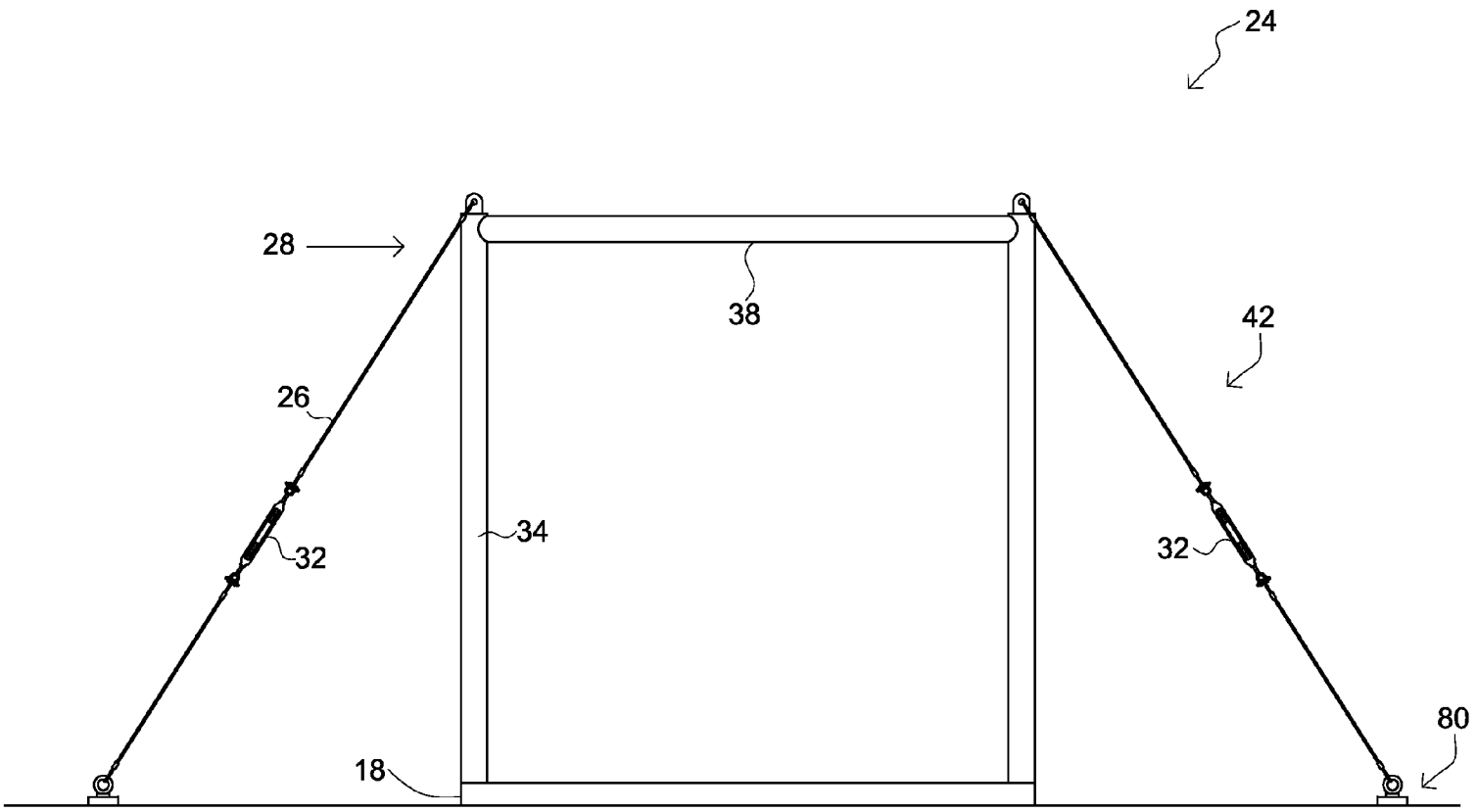
FIG. 2 is a rear elevational view of a roof lift of a hoisting platform system, according to one embodiment of the invention.

FIG. 2 is a rear elevational view of a roof lift of a hoisting platform system, according to one embodiment of the invention. There is shown a mounting structure 24 including a pole 34, a cross-beam 38, a plurality of cables 26, a pair of I-beams 18, and a plurality of anchors 80.

The illustrated mounting structure 24 is configured to securely support and anchor a floor deck to a rooftop of a building. The mounting structure 24 is configured to support a floor deck extending over a side of a building, wherein a winch coupled to the floor deck is configured to lift objects along a side of a building to various floors and levels of a building.

The illustrated mounting structure 24 includes a pole 34 coupled to a pair of beams 18 anchored to a rooftop of a building. The mounting structure 24 includes a plurality of cables 26 extending sideways from their associated poles and are configured to support and couple to the pair of upright poles 34 about a top end 28 thereof. The plurality of cables 26 includes a plurality of anchors 80 configured to securely anchor the plurality of cables 26 and the pair of upright poles 34 to the rooftop of a building. The plurality of cables 26 is configured to be anchored to the rooftop of a building, wherein the plurality of cables 26 extend from the rooftop upwardly towards a top end of a first upright pole 34, then extending across to a top end of a second upright pole, and then extending downwardly towards the rooftop of the building and anchoring thereto. The illustrated plurality of cables 26 is configured to be positioned perpendicularly to a pair of support struts of a roof attachment system. The plurality of cables 26 each include a tension adjustment device 32 to adjust the tension of the cable after installation thereof. The illustrated plurality of cables include a pair of side-anchored cables 42 positioned at a radial angle substantially orthogonal to the primary axis of the beams.

The illustrated anchors 80 are eye-bolts secured to the top surface of the illustrated roof. Anchors may include anchors/fasteners (wedge anchors, sleeve anchors, screw anchors, drop-in anchors, machine-screw anchors, expansion anchors, lag shield anchors, nail-it anchors, metal split anchors, split drive anchors, strike anchors, and the like and combinations thereof), rivets, concrete anchors, and the like and combinations thereof. The anchors will generally include some structure for coupling to cables, such as but not limited to an eye-bolt, clip, clamp, tie, weld or the like or combinations thereof. The anchors may include device(s) for selectable coupling to cables such that the cables may be detached therefrom, such as but not limited to with carabiners. However, because the roof lift is generally very heave and the loads to be lifted as well, the coupling will, in most cases be such that tools are required to detach the cable(s) from the anchors.

The illustrated mounting structure 24 includes a cross-beam 38 fixedly coupling each of the upright poles 34 at a top region 28 thereof. The cross-beam 38 transmits force between the upright structures, thereby allowing them to share support and to support each other. The mounting structure 24 includes a pair of rigid a-frame struts extending upwardly from the pair of beams. The mounting structure 24 includes a cross-beam 38 fixedly coupling the pair of rigid a-frame struts extending upwardly from each of the pair of beams 18.

Figure 3:
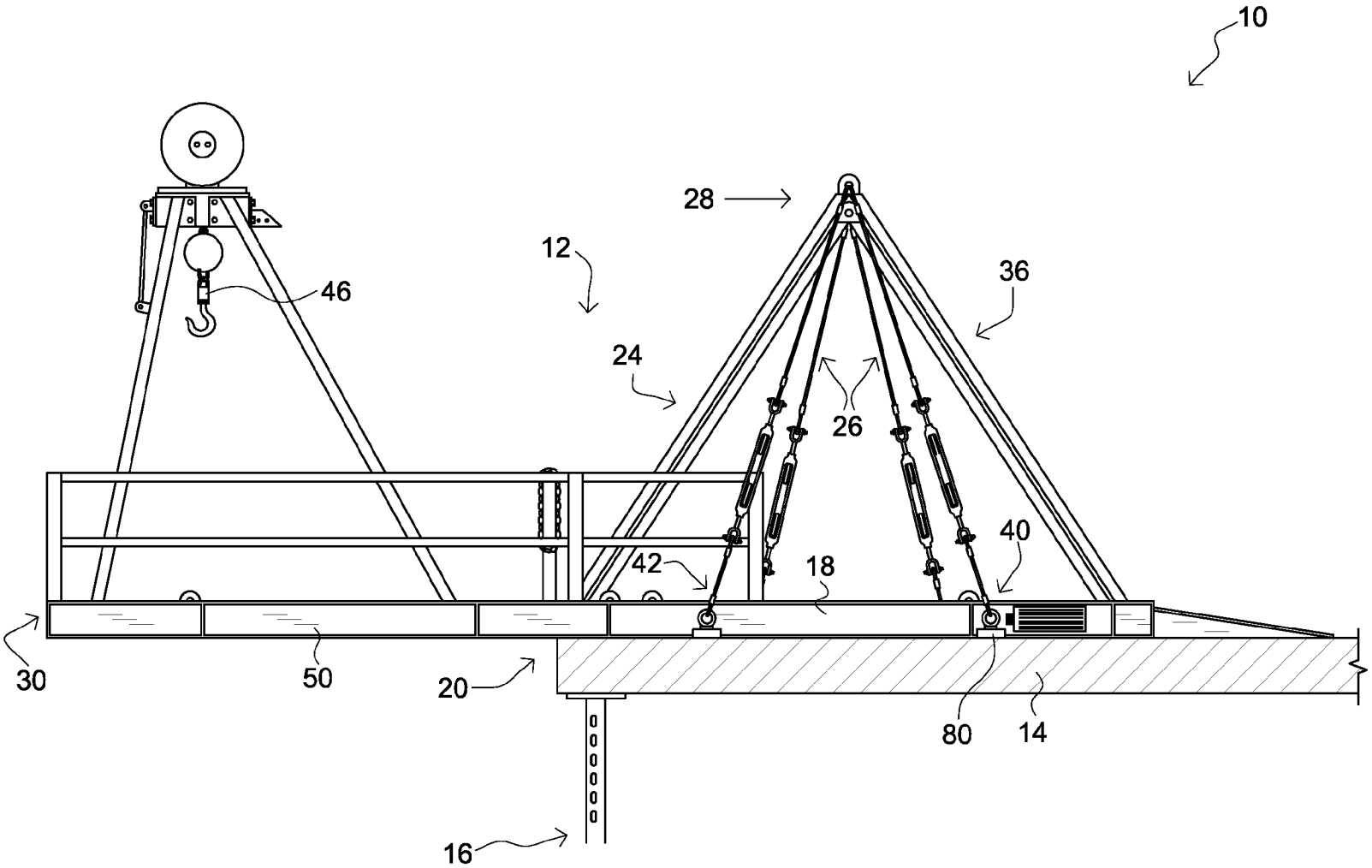
FIG. 3 is a side elevational view of a roof lift of a hoisting platform system, according to one embodiment of the invention.

FIG. 3 is a side elevational view of a roof lift of a hoisting platform system, according to one embodiment of the invention. There is shown a hoisting platform system 10 including a roof lift 12, a hydraulic winch 46, a retractable floor deck 50, and a mounting structure 24.

The hoisting platform system 10 is configured to be anchored to a floor of a building or structure. The hoisting platform system 10 is also configured to be coupled to a rooftop 14 of a building or structure 16. The hoisting platform system 10 may be configured to be coupled to a side of a bridge. The hoisting platform system 10 is configured to be attached to a structure able to support the hoisting platform system 10, typically a high-rise building. The hoisting platform system 10 includes a roof lift 12 coupled to a roof 14 of a building 16.

The illustrated hoisting platform system 10 includes a mounting structure 24 configured to support and anchor a hydraulic winch 46 to a rooftop of a building. The illustrated hydraulic winch 46 is configured to lift objects on a floor deck 30 from an area below the winch 46. The winch 46 and floor deck 30 are configured to be disposed over a side 20 of a building 16, wherein the floor deck 30 is configured to lift objects along the side 20 of the building 16 to various levels and floors of the building. Winches 46 may be powered by systems other than hydraulic systems, such as but not limited to electrical, combustion engine, and the like and combinations thereof. Power may be supplied to the winch through connection to a power grid (i.e. being plugged in), electrical connection to a motor, connection to a hydraulic system, and the like and combinations thereof.

The illustrated mounting structure 24 is configured to support the winch 46 during operational use. The mounting structure 24 includes a pair of rigid a-frame support struts 36 configured to apply downward pressure to the winch 46 during operational use. The mounting structure 24 includes a plurality cables 26 configured to securely anchor the mounting structure 24 to a rooftop 14 of a building 16. The plurality of cables 26 are configured to couple the pair of rigid a-frame support struts 36 about a top end 28 thereof. The plurality of cables 26 includes a plurality of anchors 80 configured to anchor the mounting structure 24 to a rooftop 14 of a building 16. The mounting structure 24 is configured to couple a pair of I-beam web supports 18 to the winch 46, thereby securing the winch 46 to the rooftop 14 of a building 16.

The illustrated plurality of cables 26 extend sideways from a top end 18 of the pair of rigid a-frame support struts 36 in a splayed manner (i.e. the anchors on each side are distanced from each other front to back). The plurality of cables 26 extend outwardly from an exterior side of the pair of rigid a-frame support struts 36. It may be that the plurality of cables 26 extend upwardly from the rooftop of a building, up to a top end 28 of a first rigid a-frame support structure 36 and then across to a second rigid a-frame support structure, and then extending downwardly and anchoring into the rooftop 14 of a building 16. Cables may be coupled to rigid support structures by eyelets, bolts, welds, and the like and combinations thereof. The plurality of cables 26 include a pair of rear-anchored cables 40 positioned opposite jutting ends of the beams and a pair of side-anchored cables 42 positioned at a radial angle substantially orthogonal to the primary axis of the beams.

The illustrated hoisting platform system 10 includes a retractable floor deck 50 (movable transfer deck) coupled to the mounting structure 24 and disposed opposite of the hydraulic winch 46. The removable floor deck 50 provides a resting surface on which to place objects lifted up to the roof using the winch, allows for detachment from the winch without dropping he object and may assist in laterally moving objects lifted up by the hydraulic winch. The illustrated hydraulic winch 46 is coupled to a retractable floor deck 50 coupled to the I-beam web supports 18, and configured to selectably retract the deck when not in use. The retractable floor deck 50 is in communication with an electric variable chain drive unit configured to retract and deploy the retractable deck; wherein the retractable floor deck includes a plurality of lifting points configured to retract and deploy the retractable floor deck for operational use.

Figure 4:
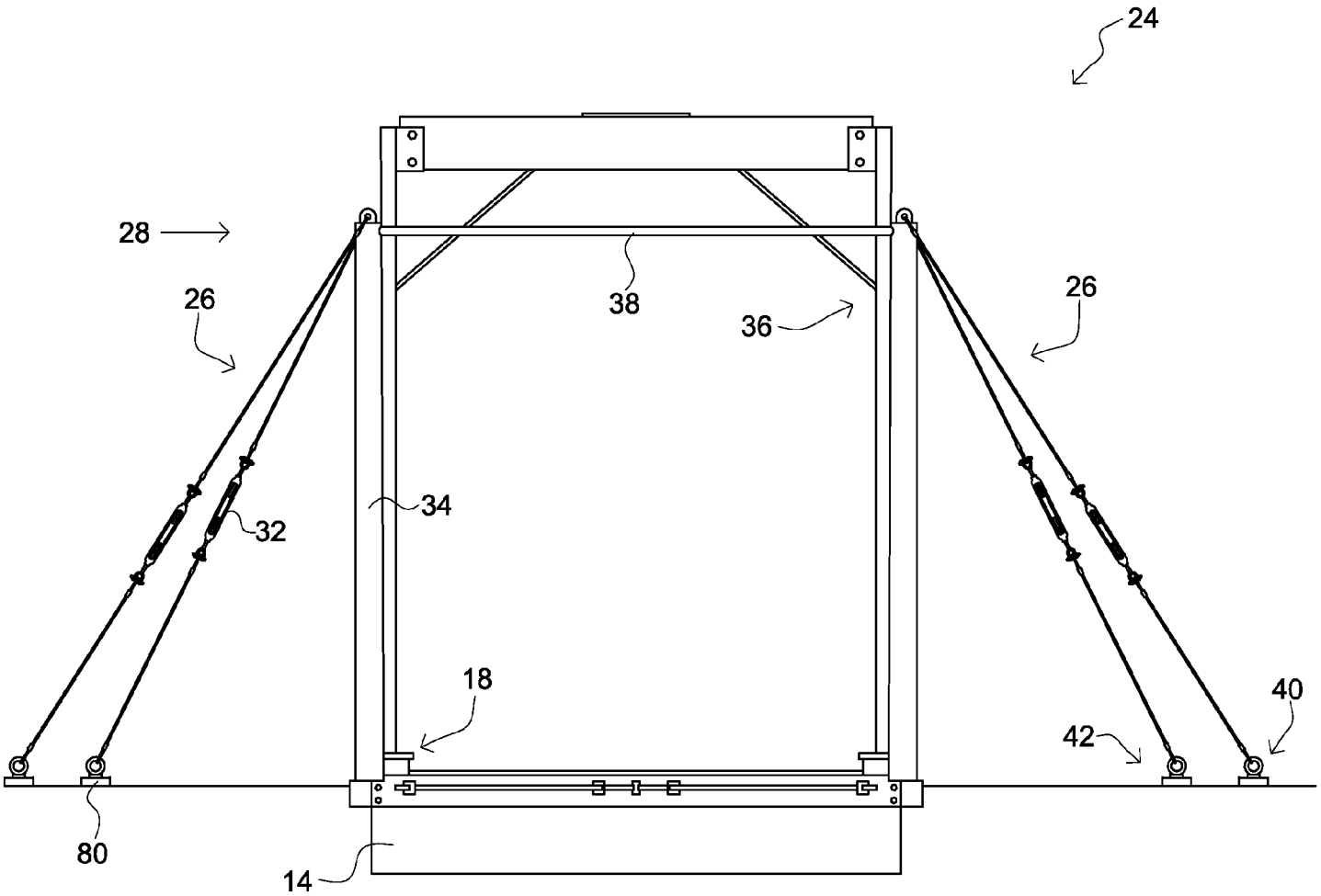
FIG. 4 is a rear elevational view of a roof lift of a hoisting platform system, according to one embodiment of the invention.

FIG. 4 is a rear elevational view of a roof lift of a hoisting platform system, according to one embodiment of the invention. There is shown a mounting structure 24 including a pair of rigid a-frame support struts 36, a plurality of cables 26, and a plurality of anchors 80.

The illustrated mounting structure 24 is configured to securely support and anchor a winch or hoist to a rooftop 14 of a building. The mounting structure 24 is configured to support a winch or hoist that is configured to be extending over a side of a building, wherein the winch or hoist is configured to lift objects disposed thereon along a side of a building to various floors and levels of a building, including to other floor decks that are coupled to floors below the roof lift, wherein floor decks are disposed below the roof lift.

The illustrated mounting structure 24 includes a pair of rigid support struts 36 anchored to a rooftop 14 of a building by cables 26. The mounting structure 24 includes a plurality of cables 26 that couple to the pair of rigid support struts 36 about a top end 28 thereof through eyelets. The plurality of cables 26 includes a plurality of associated anchors 80 configured to securely anchor the plurality of cables 26 and the pair of rigid support struts 36 to the rooftop 14 of a building. The plurality of cables 26 are configured to be anchored to the rooftop 14 of a building, wherein the plurality of cables 26 extend from the rooftop 14 upwardly towards a top end 28 of a first upright pole 34, then extending across to a top end of a second upright pole, and then extending downwardly towards the rooftop of the building and anchoring thereto. The illustrated plurality of cables 26 may be configured to be positioned perpendicularly to a pair of rigid a-frame support struts 36 of a mounting structure 24. The illustrated mounting structure 24 includes a pair of cables 26 each extending out from the pair of rigid a-frame support struts 36. The illustrated plurality of cables 26 includes a pair of rear-anchored cables 40 positioned opposite jutting ends of the beams 18 and a pair of side-anchored cables 42 positioned at a radial angle substantially orthogonal to the primary axis of the beams 18.

The mounting structure 24 includes a cross-beam 38 fixedly coupling struts 34 extending upwardly from each of the beams 18

Figure 5:
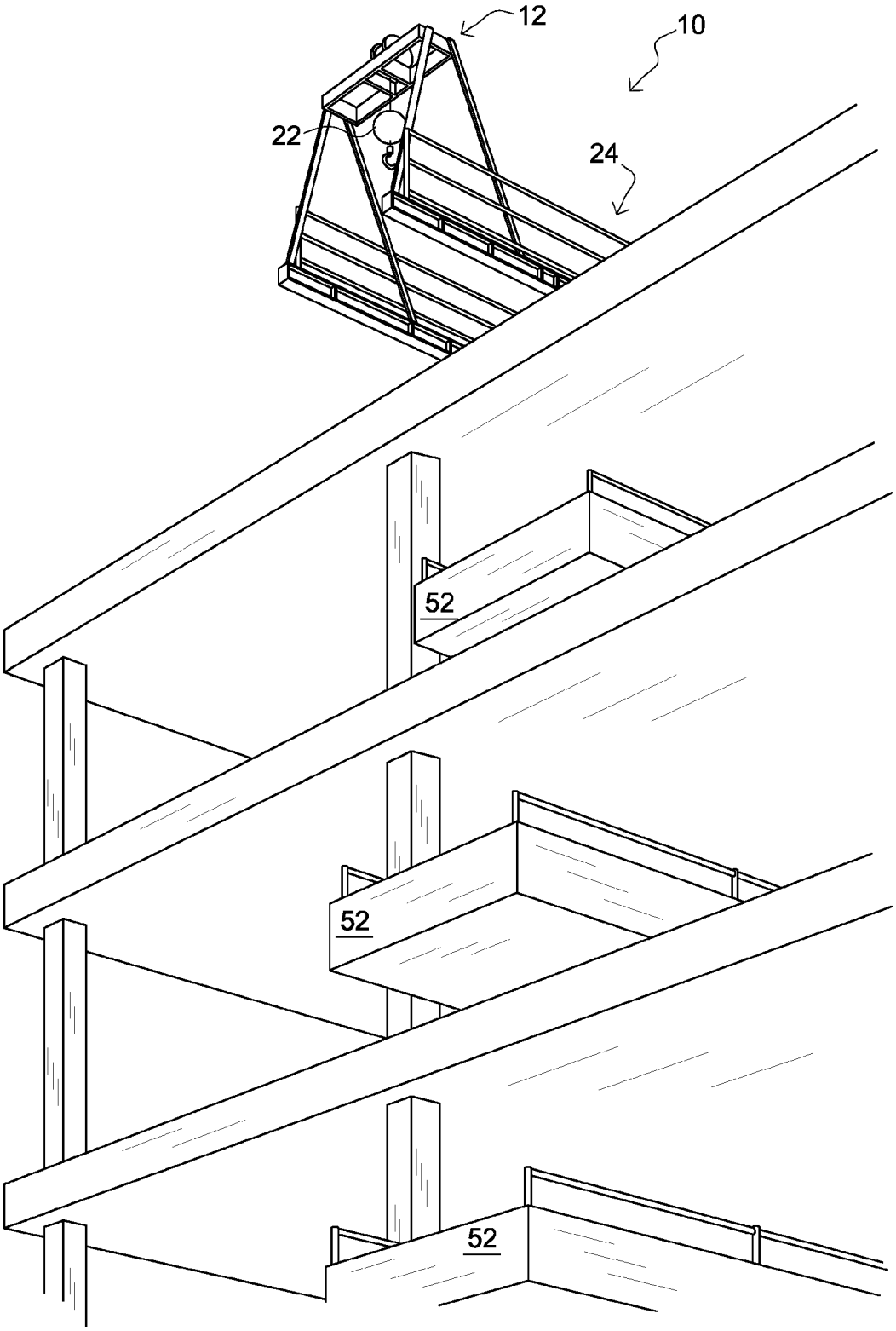
FIG. 5 is bottom perspective view of a hoisting platform system coupled to a side of a building, according to one embodiment of the invention.

FIG. 5 is bottom perspective view of a hoisting platform system coupled to a side of a building, according to one embodiment of the invention. There is shown a hoisting platform system 10 including a roof lift 12 having a winch 22, a mounting structure 24, and a plurality of floor decks 52 coupled to floors below the roof and disposed under the roof lift 12. In particular, there are three floor decks 52 illustrated below the roof lift 12 and the lower two are extended while the third (just below the roof lift) is retracted to allow for objects to pass by without interference. How the various structures are coupled to their associated surfaces is not illustrated, but for the floor decks below the roof lift, such may be accomplished with structures similar to those of the roof lift or by other structures, including but not limited to those described in U.S. Pat. No. 6,575,685 by Baxter, Sr., which is incorporated herein by reference for its supporting teachings.

The illustrated hoisting platform system 10 is configured to permit transport of loads to and between floors of a building. The hoisting platform system 10 includes a roof lift 12 coupled to a roof of a building. The roof lift 12 includes a pair of beams resting on the roof and jutting out from a side of the roof. The roof lift 12 includes a winch 22 coupled to and positioned over the beams. The winch 22 is a powered winch disposed on a platform extending upwardly from jutting ends of the beams. The platform is resting on a pair of a-frame struts, each a-frame strut is coupled to a respective beam.

The illustrated roof lift 12 includes a mounting structure 24 extending upwardly from the beams with a plurality of cables coupled to and extending from a top region of the mounting structure downwardly at an angle. The mounting structure 24 includes a pole extending upwardly from each of the beams and a cross-beam fixedly coupling each of the poles at a top region thereof. The mounting structure 24 includes a pair of rigid a-frame struts extending upwardly from the beams. The mounting structure 24 includes a cross-beam fixedly coupling struts extending upwardly from each of the beams.

The plurality of cables are fixedly coupled to the roof. The plurality of cables include tension adjustment devices. The plurality of cables include a pair of rear-anchored cables positioned opposite jutting ends of the beams. The plurality of cables includes a pair of side-anchored cables positioned at a radial angle substantially orthogonal to the primary axis of the beams. The beams are I-beams.

The hoisting platform system 10 includes a floor deck disposed below the roof lift. The floor deck is coupled to a floor of the building and extending outwardly therefrom. The roof lift 12 includes a retractable deck. The floor deck includes a retractable deck. The hoisting platform system 10 includes a plurality of floor decks 52 coupled to different floors of the building and each disposed in an array below the roof lift.

Figure 6:
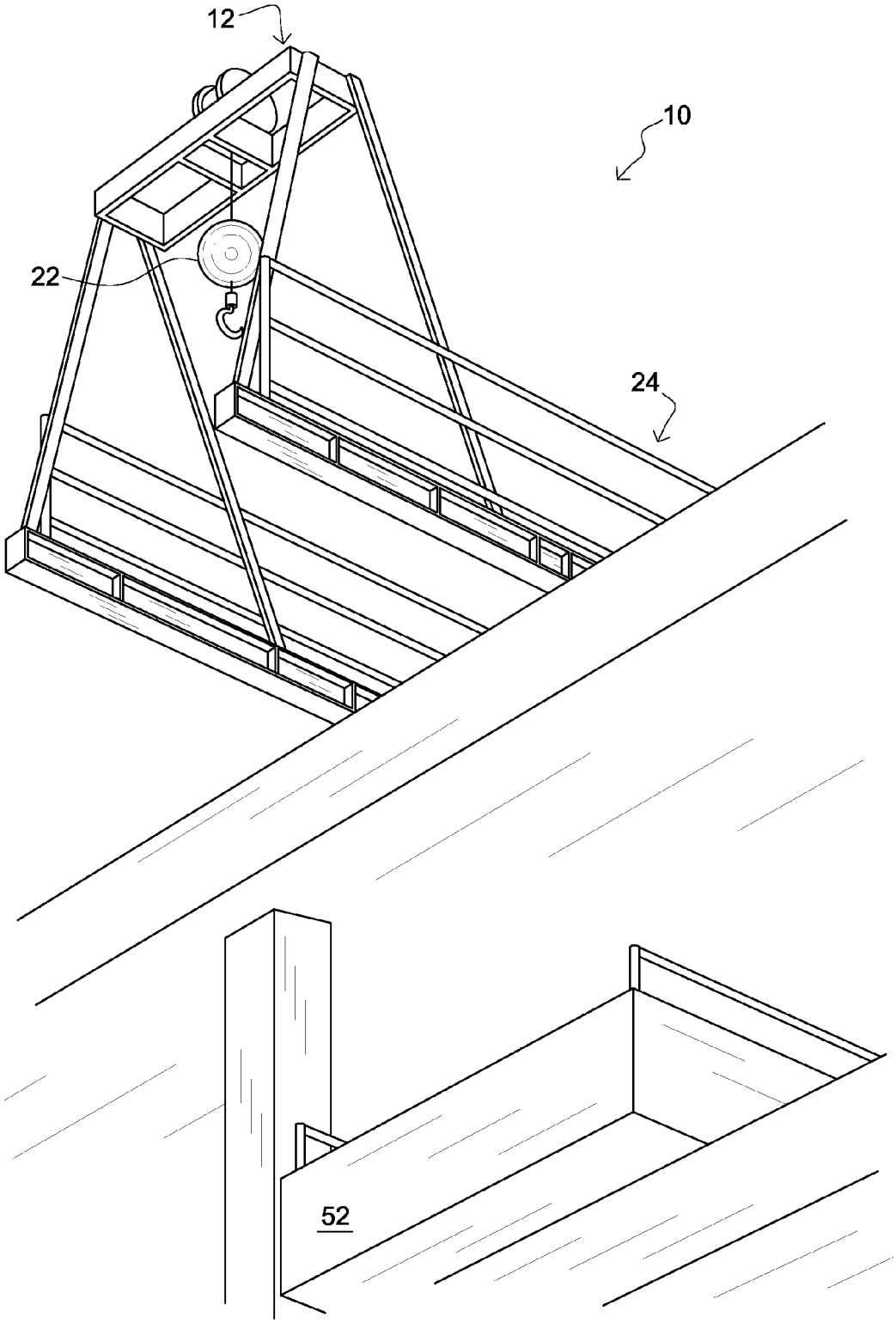
FIG. 6 is a bottom perspective view of a hoisting platform system coupled to a roof of a building, according to one embodiment of the invention.

FIG. 6 is a bottom perspective view of a roof lift coupled to a roof of a building, according to one embodiment of the invention. There is shown a roof lift 12 of a hoisting platform system 10 including a winch 22 and a mounting structure 24, and a plurality of floor decks 52.

The illustrated roof lift 12 is configured to be coupled to a roof of a building. The roof lift 12 includes a pair of beams resting on the roof and jutting out from a side of the roof. The roof lift 12 includes a winch 22 coupled to and positioned over the beams. The winch 22 is a powered winch disposed on a platform extending upwardly from jutting ends of the beams. The platform is resting on a pair of a-frame struts, each a-frame strut is coupled to a respective beam.

The roof lift 12 includes a mounting structure 24 extending upwardly from the beams with a plurality of cables coupled to and extending from a top region of the mounting structure. The mounting structure 24 includes a cross-beam fixedly coupling struts extending upwardly from each of the beams. The struts are extending upwardly from each of the beams form a-frames. The plurality of cables includes tension adjustment devices. The roof lift 12 includes a plurality of anchors coupled to ends of the cables. The hoisting platform system 10 includes a plurality of floor decks 52 coupled to different floors of the building and each disposed in an array below the roof lift.

Figure 7:
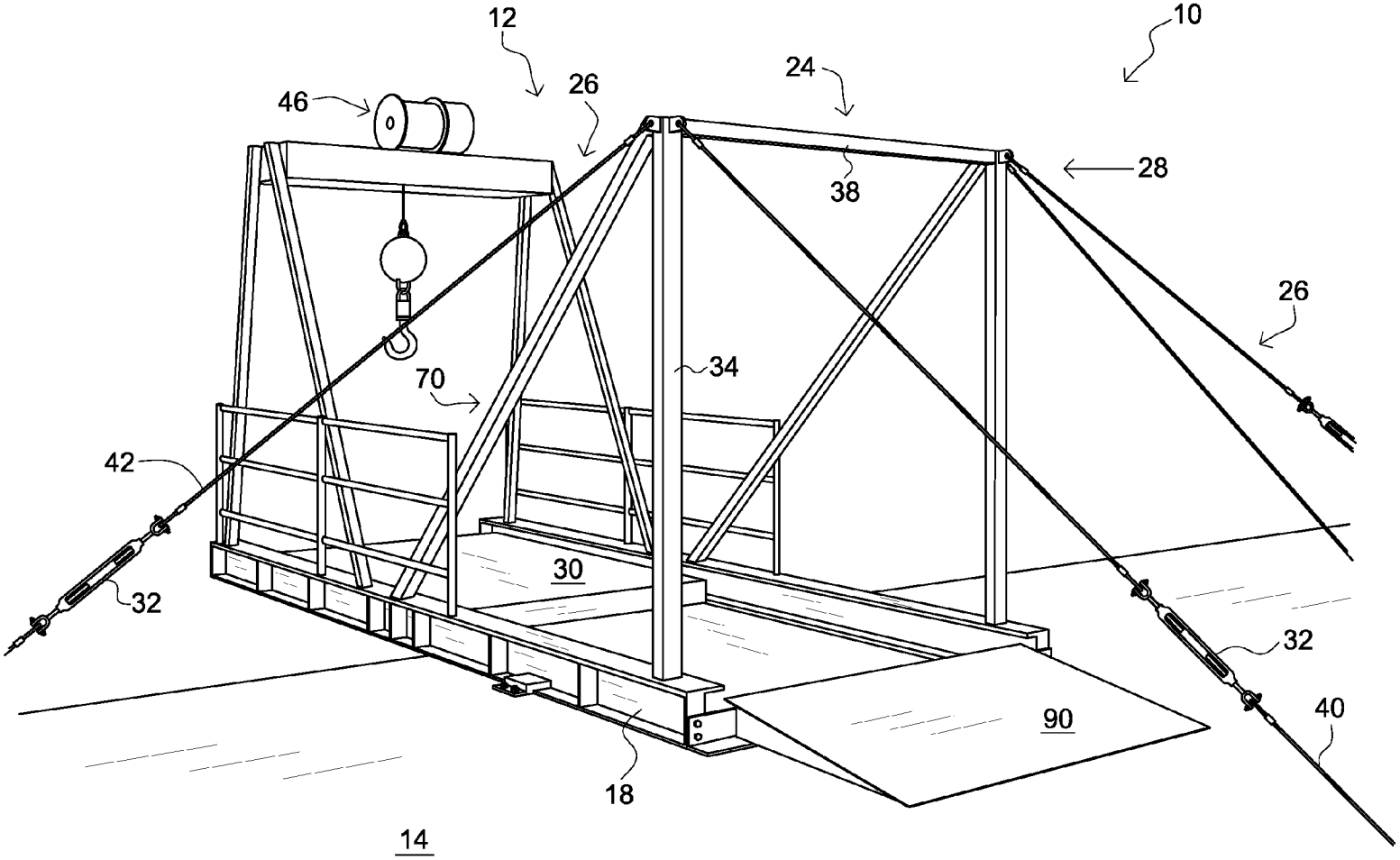
FIG. 7 is a rear perspective view of a roof lift of a hoisting platform system coupled to a roof of a building, according to one embodiment of the invention.

FIG. 7 is a rear perspective view of a roof lift of a hoisting platform system coupled to a roof of a building, according to one embodiment of the invention. There is shown a hoisting platform system 10 including a roof lift 12, a hydraulic winch 46, a mounting structure 24, and a floor deck 30.

The illustrated hoisting platform system 10 is configured to permit transport of loads to and between floors of a building. The system 10 includes a roof lift 12 configured to couple to a roof 14 of a building. The roof lift 12 includes a pair of beams 18 that are resting on the roof 14 and jutting out from a side of the roof. The roof lift 12 includes a powered hydraulic winch 46 coupled to and positioned over jutting portions of the beams 18. The roof lift 12 includes a set of rigid struts 34 extending upwardly from the beams 18 and coupled to each other at a top region 28 of the struts by a cross-beam 38. The roof lift 12 includes a plurality of cables 26 coupled to and extending from a top region 28 of the struts 34. The plurality of cables 26 each include a tension adjustment device 32 to adjust the tension of the cable after installation thereof. The roof lift 12 includes a plurality of anchors coupled to distal ends of the cables and configured to anchor the cables to a top surface of a roof. The roof lift 12 includes a retractable deck disposed between the jutting portions of the beams. The hoisting platform system 10 includes a plurality of floor decks with retractable decks configured to be disposed below the roof lift in an array, configured to be coupled to various floors of a building and to extend outwardly therefrom.

The illustrated roof lift 12 includes four cables 26 extending from a top end 28 of a mounting structure 24, with a pair of cables extending sideways 42 and a pair of cables extending rearward 40. In particular, there is shown a pair of rear-anchored cables 40 positioned opposite jutting ends of the beams and a pair of side-anchored cables 42 positioned at a radial angle substantially orthogonal (sideways) to the primary axis of the beams such that sideways support is provided to the structure sufficient to handle orthogonal force components during use, such as but not limited to those resulting from winds and/or swinging of lifted objects. The mounting structure 24 includes a pair of upright poles 34 extending upwardly from associated I-beams 18 and a pair for forward extending diagonal support poles 70 coupling the top ends 28 of the upright poles 34 to more forward regions of the I-beams 18, effectively forming an asymmetric A-frame mounting structure. The winch 46 is supported by a similarly (though opposite) asymmetric A-frame mounting structure. There is also a ramp 90 extending rearward from a position where the movable transfer deck rests in a retracted position so that materials may be loaded/unloaded from the transfer deck with additional ease. Also illustrated are safety rails configured to enhance the safety of the structure in the region of the roof lift that juts out beyond the edge of the roof.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the figures illustrate roofs as being homogenous concrete slabs with a roof lift attached thereto, it is understood that the illustrated roof lift may couple to more complicated and other various roof types.

Additionally, although the figures illustrate various structures in concert, it is understood that the structures are not necessarily to scale nor are they necessarily on the same scale as other structures in the same figures, but have been illustrated to more clearly communicate the structures themselves.

It is also envisioned that, though I-beams are readily available and relatively low costs, support structures other than I-beams may be used to form a base of a roof lift.

It is expected that there could be numerous variations of the design of this invention. An example is that the illustrated structures may be decorated, painted, and/or otherwise include ornamentation.

Finally, it is envisioned that the components of the device may be constructed of a variety of materials, including but not limited to metals, plastics, ceramics, fibers, composites and the like and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A hoisting platform system configured to permit transport of loads to and between floors of a building, comprising:

a) a roof lift coupled directly to a top surface of a roof of a building, the roof lift including a pair of beams resting on the roof and jutting out from a side of the roof, a winch coupled to and positioned over the beams, and a mounting structure extending upwardly from the beams with a plurality of cables fixedly coupled to and extending from a top region of the mounting structure downwardly at an angle, the cables being fixedly coupled to the roof; and b) a floor deck disposed below the roof lift, coupled to a floor of the building and extending outwardly therefrom, wherein the system does not include a plurality of horizontal rods at a top thereof to couple directly to an underside of a ceiling and does not include any post jacks.

2. The system of claim 1, wherein the cables include tension adjustment devices.

3. The system of claim 1, wherein the mounting structure includes a single pole extending upwardly from each of the beams and a cross-beam fixedly coupling each of the two poles at a top region thereof and no other poles extending upwardly from each of the beams.

4. The system of claim 1, wherein the mounting structure includes a pair of rigid a-frame struts extending upwardly from the beams.

5. The system of claim 1, wherein the mounting structure includes a cross-beam fixedly coupling struts extending upwardly from each of the beams.

6. The system of claim 1, wherein the cables include a pair of rear-anchored cables positioned opposite jutting ends of the beams and a pair of side-anchored cables positioned at a radial angle substantially orthogonal to the primary axis of the beams.

7. The system of claim 1, wherein the beams are I-beams.

8. The system of claim 1, wherein the winch is a powered winch that is disposed on a platform extending upwardly from jutting ends of the beams, the platform resting on a pair of a-frame struts, each a-frame strut coupled to a respective beam.

9. The system of claim 1, wherein the roof lift further includes a retractable deck.

10. The system of claim 1, wherein the floor deck includes a retractable deck.

11. The system of claim 1, further comprising a plurality of floor decks coupled to different floors of the building and each disposed in an array below the roof lift.

12. A roof lift configured to be coupled directly to a top surface of a roof of a building, the roof lift comprising:

a) a pair of beams resting on the roof and jutting out from a side of the roof, b) a winch coupled to and positioned over the beams, and c) a mounting structure extending upwardly from the beams with a plurality of cables fixedly coupled to and extending from a top region of the mounting structure but with no post jacks.

13. The roof lift of claim 12, wherein the cables include tension adjustment devices.

14. The roof lift of claim 13, further comprising a retractable deck.

15. The roof lift of claim 14, wherein the wherein the mounting structure includes a cross-beam fixedly coupling struts extending upwardly from each of the beams.

16. The roof lift of claim 15, wherein the winch is a powered winch that is disposed on a platform extending upwardly from jutting ends of the beams, the platform resting on a pair of a-frame struts, each a-frame strut coupled to a respective beam.

17. The roof lift of claim 16, wherein the struts extending upwardly from each of the beams form a-frames.

18. The roof lift of claim 17, wherein the beams are I-beams.

19. The roof lift of claim 18, further comprising anchors coupled to ends of the cables.

20. A hoisting platform system configured to permit transport of loads to and between floors of a building, comprising:

a) a roof lift configured to couple directly to a top surface of a roof of a building, the roof including a pair of beams resting on the roof and jutting out from a side of the roof, a powered winch coupled to and positioned over jutting portions of the beams, a set of rigid struts extending upwardly from the beams and coupled to each other at a top region of the struts by a cross-beam, a plurality of tension-adjustable cables fixedly coupled to and extending from a top region of the struts, anchors coupled to distal ends of the cables and configure to anchor the cables to a top surface of a roof and a retractable deck disposed between the jutting portions of the beams; and b) a plurality of floor decks with retractable decks configured to be disposed below the roof lift in an array, configured to be coupled to various floors of a building and to extend outwardly therefrom.

* * * * *